US010703554B2

(12) United States Patent
Ben-Arie

(10) Patent No.: US 10,703,554 B2
(45) Date of Patent: Jul. 7, 2020

(54) CONDIMENT DISPENSER-X

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 21 days.

(21) Appl. No.: 16/372,453

(22) Filed: Apr. 2, 2019

(65) Prior Publication Data

US 2019/0225408 A1 Jul. 25, 2019

Related U.S. Application Data

(63) Continuation-in-part of application No. 16/159,721, filed on Oct. 15, 2018.

(60) Provisional application No. 62/655,800, filed on Apr. 10, 2018, provisional application No. 62/583,519, filed on Nov. 9, 2017.

(51) Int. Cl.
*B65D 83/06* (2006.01)
*A47G 19/24* (2006.01)

(52) U.S. Cl.
CPC ..... *B65D 83/06* (2013.01); *A47G 19/24* (2013.01); *A47G 2200/205* (2013.01)

(58) Field of Classification Search
CPC .... A47G 19/24; A47G 19/34; A47G 2200/20; A47G 2200/205; B65D 83/06
See application file for complete search history.

(56) References Cited

U.S. PATENT DOCUMENTS

| | | | | | |
|---|---|---|---|---|---|
| 3,276,637 | A * | 10/1966 | Fender | A47K 5/10 | 222/345 |
| 3,435,994 | A * | 4/1969 | Freed | A47G 19/24 | 222/196 |
| 3,973,702 | A * | 8/1976 | Ferrante | A47G 19/24 | 222/196.5 |
| 4,964,546 | A * | 10/1990 | Morrow | A47G 19/34 | 222/352 |
| 5,174,470 | A * | 12/1992 | North | A47J 37/1228 | 221/150 HC |
| 5,746,355 | A * | 5/1998 | Wold | A47G 19/34 | 222/189.02 |
| 7,032,787 | B2 * | 4/2006 | Sherk, Jr. | G01F 11/18 | 222/156 |
| 9,591,943 | B2 * | 3/2017 | Murray | A47J 31/404 | |
| 2008/0014384 | A1 * | 1/2008 | Lin | A47G 19/24 | 428/34.1 |

* cited by examiner

*Primary Examiner* — Ryan A Reis

(57) ABSTRACT

A condiment dispenser which is activated by an electrical vibrator is described. The dispenser has a container with a storage space filled with condiment. The bottom wall of the container is riddled with a multiplicity of spreading apertures. At the idle state the vibrator is deactivated and the apertures are blocked by a banded frame. The blocking frame isolates the condiment and prevents atmospheric moisture accumulation. At the active state the activated vibrator vibrates the condiment while the banded frame is moved such that the apertures are uncovered and facilitate condiment spreading. A multiple condiments dispenser is also presented. The multiple condiments dispenser has several separate containers and a vibrator which can vibrate all the condiments. The user selects which particular condiment to dispense by pressing the button which uncovers the apertures of the selected container while activating the vibrator.

12 Claims, 3 Drawing Sheets

A–A
B
B

A
A

B–B

A–A

B-B
A
B
1
2
3
4
5
6
7
8
9
11
12
13
14

A-A

B-B

CONDIMENT DISPENSER-X

CROSS-REFERENCE TO RELATED APPLICATIONS

This Application is a Continuation In Part of application Ser. No. 16/159,721 filed on Oct. 15, 2018.

This Application also claims priority from a Provisional Patent Application: Ser. No. 62/655,800 filed on Apr. 10, 2018.

FEDERALLY SPONSORED RESEARCH

Not Applicable.

SEQUENCE LISTING OR PROGRAM

Not Applicable.

TECHNICAL FIELD

The present invention relates to condiment dispensers.

PRIOR ART

Many devices were invented for dispensing particulate condiments such as salt and pepper. However the operation of a large majority of them is based on shaking the container and ejecting the condiment particulates via a set of small apertures. The purpose of shaking is to accelerate the particulates in the container upwards and downwards. The upwards acceleration is converted into inertial forces downwards when the container is abruptly accelerated in the reverse direction. These inertial forces are adding to the gravity of the particulates and push and eject the particulates downwards through a set of apertures thence due to gravity they fall on the food below.

However, condiments and especially salt are naturally hygroscopic and have a tendency to accumulate atmospheric moisture which causes them to coagulate both within the container and also at its apertures. Only few salt dispensers such as U.S. Pat. No. 1,773,720 to All and proposed specialized mechanisms for loosening coagulated salt. However, these mechanism do not function as efficient dispensing mechanisms because loosening coagulated salt or other condiments still requires also to actively push them outside through the apertures. Manual dispenser shaking does not generate enough inertial forces which are sufficient to propel moist condiment particulates which tend to adhere to one another and to the walls of the container. Thus, one needs to apply additional propelling mechanism in order to achieve efficient dispensing. In our patent search, we could not find salt or other condiment dispensers with efficient means for pushing and ejecting salt or other condiments. In patent application Ser. No. 16/159,721 filed on Oct. 15, 2018 Ben-Arie proposed a special transferring mechanism which translates and spreads the condiment. But this approach is different in principle from our approach presented in this Application.

BRIEF SUMMARY OF THE INVENTION

Manual dispenser Shaking is not equivalent to mechanical dispenser vibrations which can have much higher frequency and more importantly—much higher acceleration which is translated into inertial forces pushing the condiment particulates via the apertures in the condiment container. These inertial forces are capable also of loosening coagulated condiment lumps in the container and isolating each condiment particulate from other particulates. At this stage, each particulate vibrates freely and is propelled only by its own inertial forces and its own weight. Thus freely vibrating particulates can be easily guided towards the dispenser's dispensing apertures.

We have several goals in inventing and developing our Condiment Dispenser X of which some feasible embodiments are illustrated in FIGS. 1-6:

1. To develop a condiment dispenser with a mechanical vibration based dispensing mechanism that is configured to loosen the condiment coagulation in the condiment container. The vibration strength is configured to loosen the condiment lumps in the container into isolated and accelerated particulates that can be propelled by their own weight and their own inertial forces and slide downwards and through the container's dispensing apertures.
2. To develop a vibration based dispensing mechanism that is designed to generate a substantially constant condiment dispensation rate such that the total amount dispensed is proportional to the time period the vibration based dispensing mechanism is being activated. By this manner, the user can accurately control the amount of condiment sprinkled on the food by controlling the time period of each manual activation.
3. To develop a condiment container with a dispensing mechanism that can be held and operated manually using just one hand. It is also advantageous if the dispenser dispenses the condiment directly downwards without needing to downturn the dispenser.
4. To develop condiment dispenser with a dispensing mechanism which effectively isolates the condiment stored in the container from the surrounding atmosphere during inactive periods. By this manner, the dispensing mechanism prevents accumulation of atmospheric moisture in the condiment. In order to achieve this goal, the dispensing mechanism is configured to expose the condiment only when the vibration mechanism is being activated.
5. To develop a condiment container that can be refilled easily and continues to supply the sprinkling mechanism with condiment as long as condiment is still present in the container.
6. To develop a condiments container which stores several different condiments and utilizes the vibration mechanism to selectively dispense each condiment with the same vibration mechanism.

In order to achieve the objectives listed above, we adopt an electrical vibration mechanism which generates vibrations which are sufficiently strong to loosen coagulated condiment lumps in the dispenser's container and to separate them into isolated condiment particulates. A preferred vibration mechanism is a vibrator which mostly generates vertical vibrations that can accelerate the isolated condiment particles in downwards direction towards the container's dispensing apertures. If vertical vibrations are not sufficient to separate coagulated condiment particles the vibration mechanism should be configured to generate also horizontal vibrations. There are two options to transmit the vibrations from the vibrator to the stored condiment. The first option is to structurally connect the electrical vibrator to the container walls and to transmit the vibrations via the container's walls. A second option is to transmit the vibrations via a vibrating bar which is connected at one end to the vibrator while the other end of the vibrating bar is connected to a banded frame which is immersed in the condiment. The banded frame has a set of spaced bands which are configured to block the dispensing apertures when the banded frame is in "blocking" state and to uncover all the dispensing apertures when the banded frame is in the "unblocking" state.

The single condiment dispenser comprises of a single condiment container comprising: a storage space filled with the condiment. The storage space is confined within: a bottom wall situated at a bottom side of the storage space, a top wall situated at a top side of the storage space and a set of surrounding walls which may include: a frontal wall, a rear wall, a left wall and a right wall. However, the configuration of the condiment container described above could be entirely different without having to change the operational principles of this invention which are based on using vibration mechanism for condiment loosening and dispensation. For example, the number of walls of the container could be different and they do not have to be planar. In a single condiment dispenser, in addition to the container compartment, the dispenser includes two more compartments. One compartment houses the vibrator and the second houses the electrical batteries which provide the electrical power which operates the vibrator. In addition, the dispenser has a push button electrical switch with which the user activates the vibrator.

We find that other prevalent condiment dispensers dispense their condiments via open apertures which are exposing their condiment containers to the environment. This prevalent approach does not prevent natural accumulation of moisture in hygroscopic condiments, which causes excessive condiment coagulation and also results in aperture blockage by moist and sticky condiment. In contrast, our dispensing mechanism minimizes condiment coagulation by isolating the condiment container from the environment all the time and does not employ aperture dispensing. Hence, an important consideration in the design of the dispenser is to isolate the stored condiment from the atmosphere at idle periods to prevent accumulation of moisture which causes condiment coagulation. This could be achieved using a banded moving frame, which is configured to cover and seal the dispensing apertures of the dispenser when the vibrator is inactive and the dispenser is idle. In the first option, where the vibrator is connected to the container's walls, the banded frame could be moved by a sliding bar which is coupled with the pressing button of the activation switch of the vibrator. Thus, when the activation switch is pressed the sliding bar moves the banded frame to an "unblocking" position in which the dispensing apertures of the container are opened. On the other hand, when the activation switch is not pressed the sliding bar keeps the banded frame in a "blocked" position in which the dispensing apertures are sealed.

In the second option the vibrator could be configured to be connected to the banded frame which will have dual tasks. One task is to transmit the vibrator's vibrations to the condiment. The second task is to block the dispensing apertures of the container when the vibrator is idle and to unblock the dispensing apertures when the vibrator is active. For the second task the vibrator has to be configured to move the vibrating bar connected to the banded frame into an unblocked position in addition to the transmission of vibrations to the banded frame.

Positioning the dispensing apertures at the floor of the container, achieves both goals number 3 and 5. The dispenser can be operated with one hand since it has its dispensing apertures at the bottom of the container and the user is not required to upturn it. In addition, having the dispensing apertures at the bottom of the container, guarantees that these dispensing apertures will be supplied with ample amount of condiment as long as condiment remains in the container.

The container compartment also has an input opening in the top wall which is used to supplement the container with condiment. The input opening includes a door rotatably installed on a hinge at the input opening. The door is configured to open or close the input opening. The door facilitates supplementing the condiment container when the door is opened. The door seals the condiment container when the door is closed. The door includes a door handle configured to facilitate manual door opening and closing. The hinge is configured to facilitate door turning for opening and closing. The input opening also includes a door stopper, which configured to adjust door closing position.

As for the multiple condiments dispenser. The structure is very similar to the single condiment dispenser. In addition to the vibrator and its electrical power source, the multiple condiments dispenser has for each particular condiment a particular container which stores only that particular condiment. These particular containers are separated by walls. Each particular container has a storage space with a multiplicity of dispensing apertures at the bottom and a supplementing opening at the top. Placed on the top side of the bottom wall is a banded frame which is configured to seal all the dispensing apertures at "blocking" frame position and to uncover the dispensing apertures at "unblocking" frame position. Each of the banded frames can be moved by a sliding bar (a rigid bar) which is coupled with a particular pressing button for activation of a particular electrical switch which activates the vibrator when pressed. Each particular container has a particular switch. So when the user wants to dispense a particular condiment, the user presses the particular condiment's pressing button which uncovers only the dispensing apertures of the particular condiment's storage space and at the same time activates the vibrator. The resulting vibrations spread only the particular condiment which has uncovered dispensing apertures because all the other particular condiments are sealed in their particular containers. All the particular switches can be connected to the same vibrator in parallel. Thus, pressing any of the particular pressing switches activates the vibrator. To prevent condiment leakage from the containers at the margins of the banded frames which engage with the surrounding walls of their containers while moving the frames, the margins of the banded frames are covered with tapered ramps which are attached to the bottom sides of surrounding containers' walls.

DETAILED DESCRIPTION OF THE DRAWINGS

Figures 1, 2, 3:
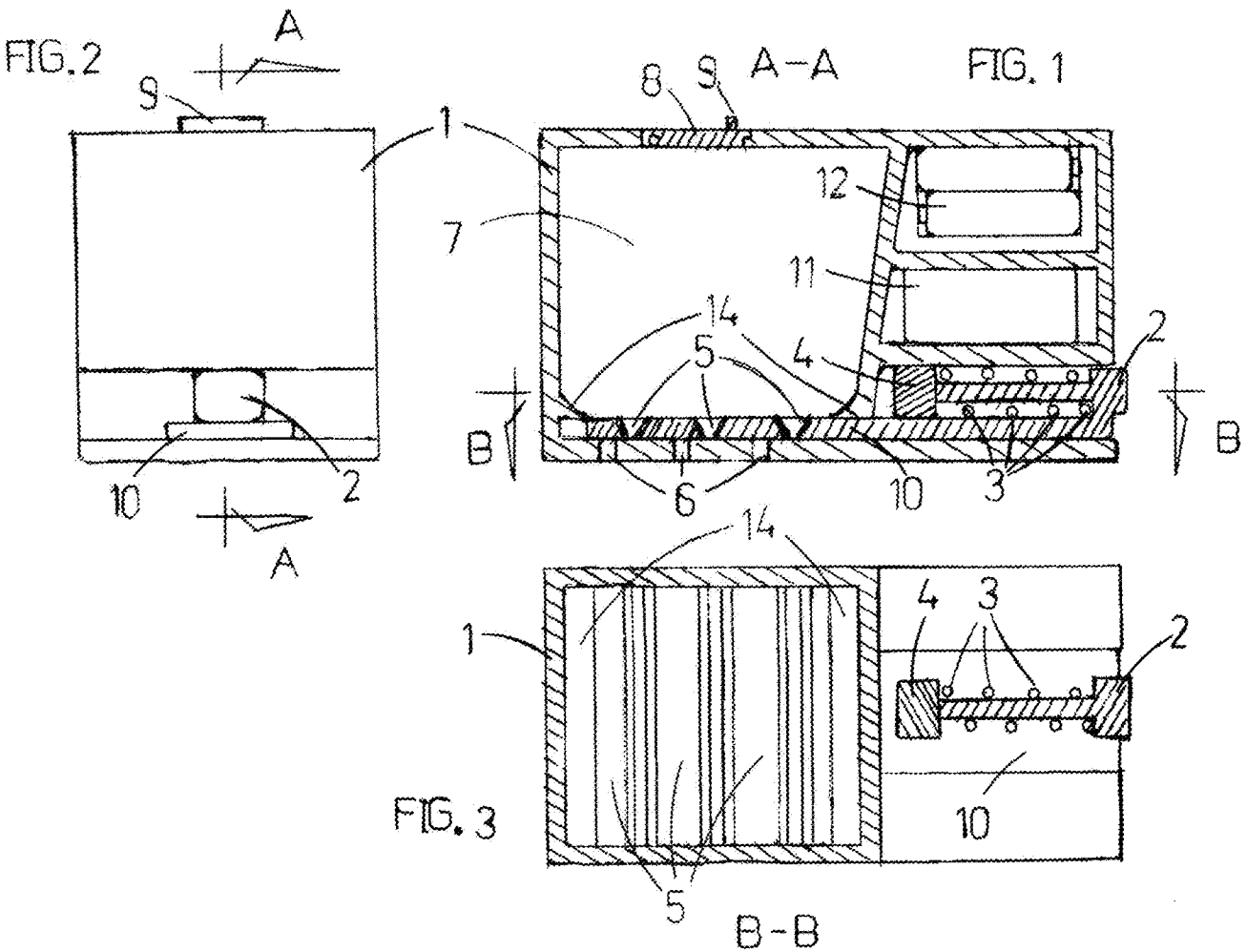
FIG. 1 illustrates a cross sectional drawing of the frontal view of an embodiment of the condiment dispenser X which is configured for dispensing a single condiment.
FIG. 2 describes a side view of the embodiment of condiment dispenser X described in FIG. 1.
FIG. 3 Depicts a cross sectional top view of the embodiment of condiment dispenser X described in FIG. 1.

FIG. 1 illustrates a cross sectional drawing of the frontal view of an embodiment of the condiment dispenser X denoted by 1. The pressing button 2 is spring 3 loaded and is mechanically connected to the electrical switch 4 which activates the vibrator 11. The spring 3 moves back the pressing button 2 and the switch 4 into the inactive position when the manual pressing ceases. The retaining spring 3 also returns the banded frame to the blocking position when the manual pressing ceases. The electrical vibrator 11 is structurally connected to the walls of the dispenser 1. With this arrangement, the dispenser's walls transfer the vibrations from the vibrator 11 to the condiment stored in container 7. The push button 2 is mechanically connected also to the sliding bar 10 which can slide the banded frame 5. The push button 2 is retained by spring 3 which moves back the pressing button and deactivates the electrical switch 4 when the push button 2 is not pressed. When the push button 2 is not pressed and the vibrator 11 is inactive, the banded frame 5 blocks the dispensing apertures 6 and isolates the condiment in container 7 from the surrounding atmosphere. In this idle or inactive state, the banded frame 5 prevents the accumulation of atmospheric moisture in the condiment. But when the push button 2 is manually pushed to the left by the user, the vibrator 11 is activated and the sliding bar 10 moves the banded frame 5 to the left such that the dispensing apertures 6 become unblocked and facilitate spreading condiment. The tapered ramps 14 are attached to the surrounding walls of the container and also fit snugly with the margins of the banded frame. The tapered ramps are configured to prevent the condiment leakage from the container 7 via the margins of the banded frame which engages the surrounding walls of the container. The electrical batteries 12 which are electrically connected to the electrical switch 4 and to the vibrator 11, provide electrical power that activates the vibrator 11 when the electrical switch 4 is activated. The rotatable door 8 is used for condiment supplementation. The handle 9 facilitate opening the door 8.

FIG. 2 describes a side view of the embodiment of condiment dispenser X denoted by 1 described in FIG. 1. The push button 2 is illustrated on top of the sliding bar 10. Also the rotatable door handle 9 is shown.

FIG. 3 Depicts a cross sectional top view of the embodiment of condiment dispenser X denoted by 1 and described in FIG. 1. The activation button 2 is spring 3 retained and is mechanically connected to the electrical switch 4 which activates the vibrator 11. When the pressing button 2 is manually pressed the switch 4 is activated and activates also the vibrator 11 at the same time the sliding bar 10 which is connected to the pressing button, moves the banded frame 5 into unblocked position in which the dispensing apertures 6 are unblocked by the banded frame 5 and facilitate spreading of the condiment. When the manual pressing ceases, the spring 3 returns the pressing button and the electrical switch back into the inactive position and at the same time the sliding bar 10 returns the banded frame 5 into the blocking position. The spring 3 returns the pressing button 2 and the switch 4 into the inactive position when the manual pressing ceases. The retaining spring 3 also returns the banded frame to the blocking position when the manual pressing ceases. The electrical vibrator 11 is structurally connected to the walls of the dispenser 1. The dispenser's walls transfer the vibrations from the vibrator 11 to the condiment stored in container 7. The push button 2 is mechanically connected also to the rigid sliding bar 10 which can slide the banded frame 5 into the unblocked position when the pressing button 2 is manually pressed. The push button 2 is retained by spring 3. When the push button 5 is not pressed and the vibrator 11 is inactive, the banded frame 5 blocks the dispensing apertures 6 and isolate the condiment in container 7 from the surrounding atmosphere. In this idle state, the banded frame 5 prevents the accumulation of atmospheric moisture in the condiment. But when the push button 2 is manually pushed to the left by the user the vibrator 11 is activated and the sliding bar 10 moves the banded frame 5 to the left such that the apertures 6 become unblocked and facilitate spreading condiment. The tapered ramps 14 are configured to prevent the condiment leakage from the container 7.

Figures 4, 5, 6:
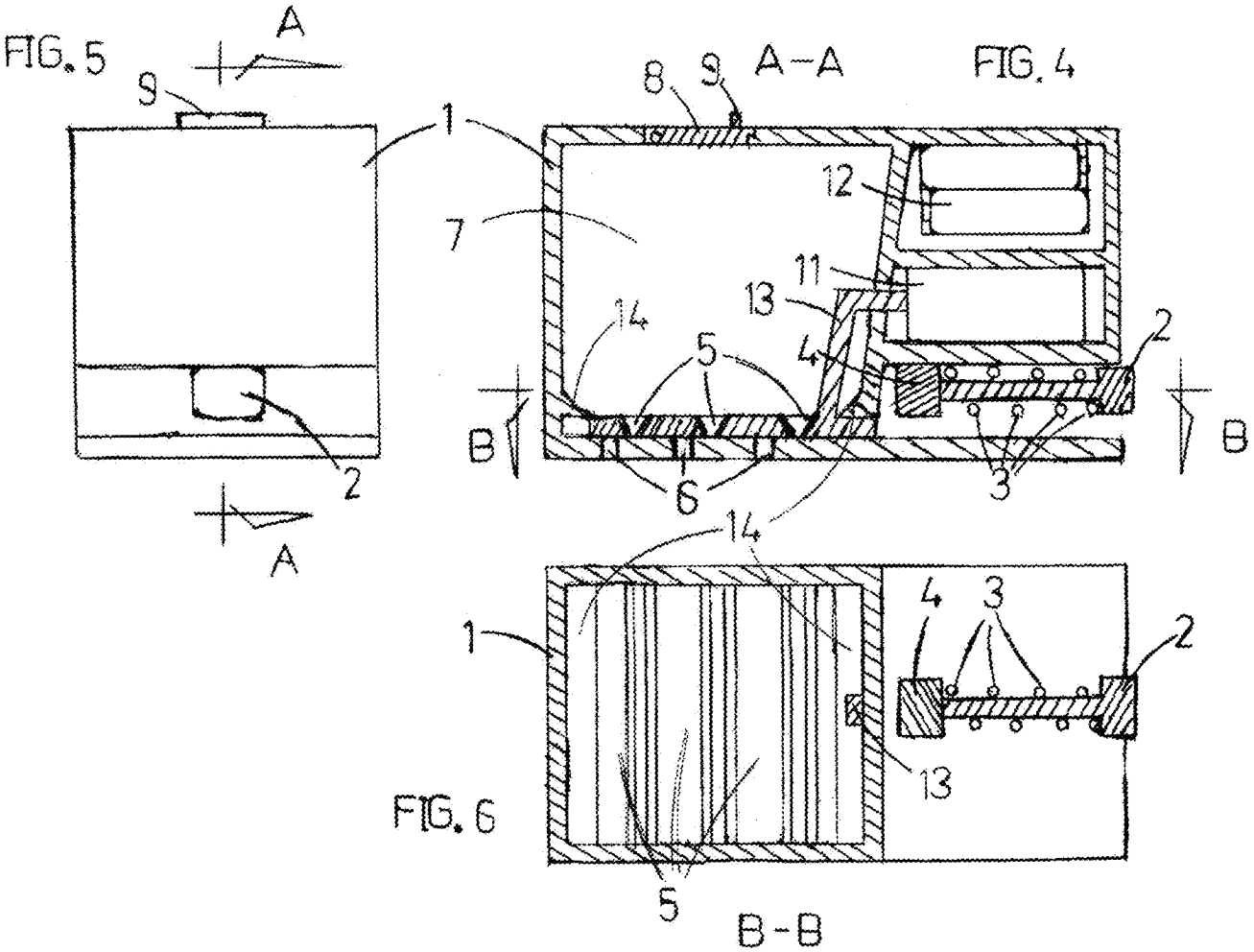
FIG. 4 illustrates a cross sectional drawing of the frontal view of an embodiment of the condiment dispenser X with the vibrating bar connecting the vibrator to the banded frame.
FIG. 5 describes a side view of the embodiment of condiment dispenser X with the vibrating bar option described in FIG. 4.
FIG. 6 Depicts a cross sectional top view of the embodiment of condiment dispenser X with the vibrating bar option described in FIG. 4.

FIG. 4 illustrates a cross sectional drawing of the frontal view of an embodiment of the condiment dispenser X denoted by 1 with the vibrating bar 13 option. The activation button 2 is spring 3 loaded and is mechanically connected to the electrical switch 4 which activates the vibrator 11. The electrical vibrator 11 is structurally connected to the walls of the dispenser 1. The dispenser's walls transfer the vibrations from the vibrator 11 to the condiment stored in container 7. The vibrator 11 is mechanically connected also to the vibrating bar 13 which can vibrate and also slide the banded frame 5 into unblocked position when vibrator 11 is activated. The push button 2 is retained by spring 3. When the push button 5 is not pressed and the vibrator 11 is inactive, the banded frame 5 blocks the dispensing apertures 6 and isolate the condiment in container 7 from the surrounding atmosphere. In this idle state, the banded frame 5 prevents the accumulation of atmospheric moisture in the condiment. But when the push button 2 is manually pushed to the left by the user the vibrator 11 is activated and the vibrating bar 13 vibrates and also moves the banded frame 5 to the left such that the apertures 6 become unblocked and facilitate spreading condiment. The rounded ramps 14 are configured to prevent the condiment leakage from the container 7. The electrical batteries 12 which are electrically connected to the electrical switch 4 and to the vibrator 11, provide electrical power that activates the vibrator 11 when switch 4 is activated. The rotatable door 8 is used for condiment supplementation. The handle 9 facilitate opening the door 8.

FIG. 5 describes a side view of the embodiment of condiment dispenser X denoted by 1 with the vibrating bar 13 option and described in FIG. 4. The push button 2 is illustrated. Also the rotatable door handle 9 is shown.

FIG. 6 Depicts a cross sectional top view of the embodiment of condiment dispenser X denoted by 1 with the vibrating bar 13 option which is and described in FIG. 4. The activation button 2 is spring 3 loaded and is mechanically connected to the electrical switch 4 which activates the vibrator 11. The electrical vibrator 11 is mechanically connected to the walls of the dispenser 1. The vibrating bar 13 transfers the vibrations from the vibrator 11 to the condiment stored in container 7. But when the push button 2 is manually pushed to the left by the user the vibrator 11 is activated and the vibrating bar 13 vibrates and also moves the banded frame 5 to the left such that the apertures 6 become unblocked and facilitate spreading condiment. The push button 2 is retained by spring 3. When the push button 5 is not pressed and the vibrator 11 is inactive, the banded frame 5 blocks the dispensing apertures 6 and isolate the condiment in container 7 from the surrounding atmosphere. In this idle state, the banded frame 5 prevents the accumulation of atmospheric moisture in the condiment. But when the push button 2 is manually pushed to the left by the user the vibrator 11 is activated and the vibrating bar 13 vibrates the condiment and also moves the banded frame 5 to the left such that the apertures 6 become unblocked and facilitate spreading condiment. The rounded ramps 14 are configured to prevent the condiment leakage from the container 7.

Figures 7, 8, 9:
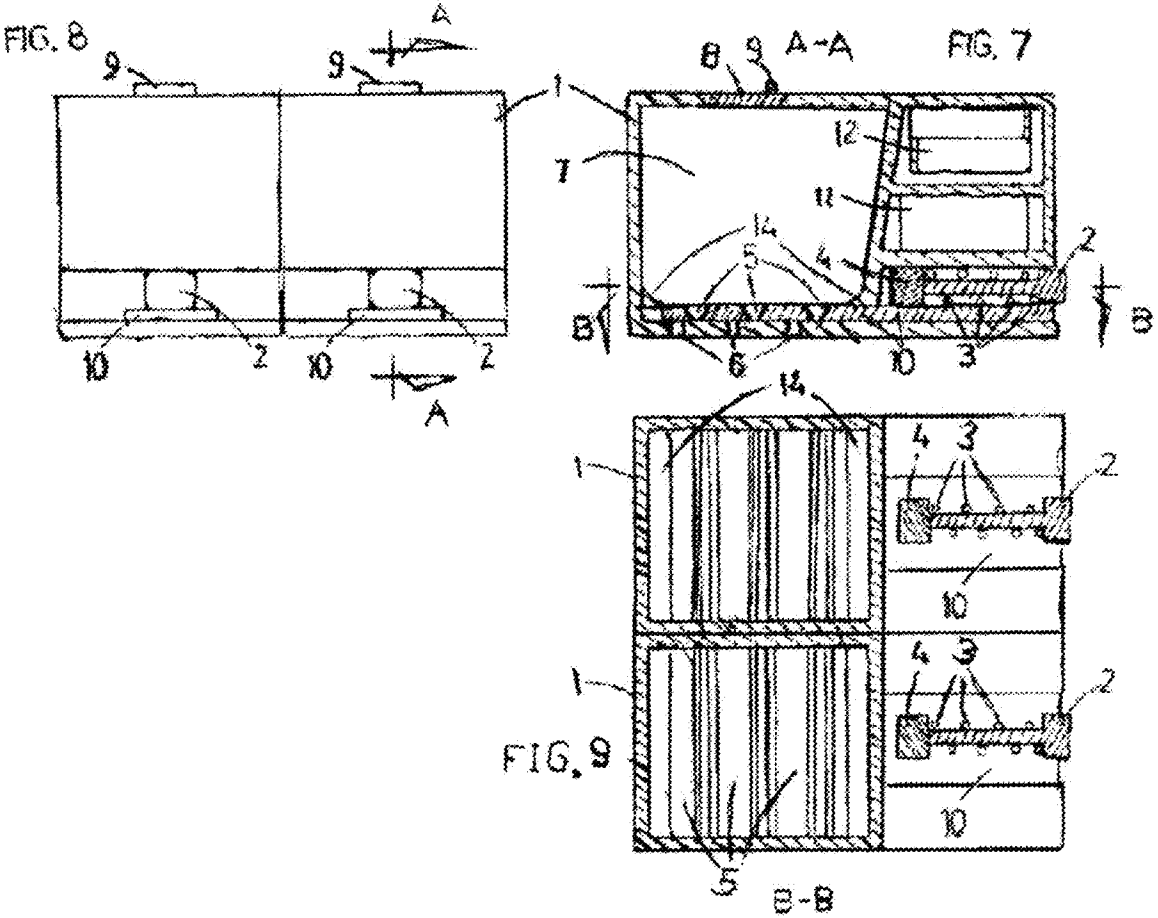
FIG. 7 illustrates a cross sectional drawing of the frontal view of an embodiment of a multiple condiments dispenser X which is configured for dispensing two condiments. A multiple condiments dispenser for more than two condiments will have very similar structure with additional condiment containers.
FIG. 8 describes a side view of the embodiment of the multiple condiments dispenser X described in FIG. 7.
FIG. 9 Depicts a cross sectional top view of the embodiment of multiple condiments dispenser X described in FIG. 7.

FIG. 7 illustrates a cross sectional drawing of the frontal view of an embodiment of a multiple condiments dispenser X which is configured for dispensing two condiments. A multiple condiments dispenser for more than two condiments will have very similar structure with additional condiment containers.

The only difference between FIGS. 1, 2, 3 and FIGS. 7, 8 and 9 is the attachement of a second container with a storage space 7 to the first container. As illustrated, the second container also has a banded frame 5 dispensing apertures 6 a pressing button 2 which is connected to an electrical switch 4 and to a sliding bar 10 both retrievable by a retaining spring 3. The tapered ramps 14 are also drawn.

FIG. 8 describes a side view of the embodiment of the multiple condiments dispenser X described in FIG. 7.

FIG. 9 Depicts a cross sectional top view of the embodiment of multiple condiments dispenser X described in FIG. 7.

What is claimed is:

1. A condiment dispenser comprising of:

a vibrator and a condiment container comprising:

a storage space filled with the condiment;

wherein the storage space is confined within: a set of surrounding walls, a bottom wall situated at a bottom side of the storage space and a top wall situated at a top side of the storage space;

wherein the bottom wall includes a multiplicity of dispensing apertures;

wherein the vibrator is configured to vibrate and also to vibrate the condiment when the vibrator is in an active state;

wherein when the vibrator is in the active state, the vibrator is configured to facilitate dispensing the condiment via the multiplicity of dispensing apertures;

wherein the storage space comprises:

an input opening;

wherein the input opening is situated at the top side of the storage space and is configured to facilitate supplementing the condiment container with the condiment;

wherein the input opening is equipped with a rotatable door which has an opened position in which the rotatable door facilitates supplementation of the condiment into the container;

wherein the rotatable door has a closed position in which the rotatable door hermetically seals the input opening.

2. A condiment dispenser comprising of:

a vibrator and a condiment container comprising:

a storage space filled with the condiment;

wherein the storage space is confined within: a set of surrounding walls, a bottom wall situated at a bottom side of the storage space and a top wall situated at a top side of the storage space;

wherein the bottom wall includes a multiplicity of dispensing apertures;

wherein the vibrator is configured to vibrate and also to vibrate the condiment when the vibrator is in an active state;

wherein when the vibrator is in the active state, the vibrator is configured to facilitate dispensing the condiment via the multiplicity of dispensing apertures;

wherein the storage space comprises:

a banded frame situated on a top side of the bottom wall;

wherein the banded frame comprises of a multiplicity of spaced bands which are configured to cover the multiplicity of dispensing apertures and to block the multiplicity of dispensing apertures when the banded frame is in a blocking position;

wherein when the banded frame is in an unblocking position, the multiplicity of spaced bands are configured not to cover the multiplicity of dispensing apertures and do not block the multiplicity of dispensing apertures;

wherein, at the unblocking position, the banded frame facilitates dispensation of the condiment via the multiplicity of dispensing apertures when the vibrator is in the active state.

3. A condiment dispenser comprising of:

a vibrator and a condiment container comprising:

a storage space filled with the condiment;

wherein the storage space is confined within: a set of surrounding walls, a bottom wall situated at a bottom side of the storage space and a top wall situated at a top side of the storage space;

wherein the bottom wall includes a multiplicity of dispensing apertures;

wherein the vibrator is configured to vibrate and also to vibrate the condiment when the vibrator is in an active state;

wherein when the vibrator is in the active state, the vibrator is configured to facilitate dispensing the condiment via the multiplicity of dispensing apertures;

wherein the vibrator is structurally attached to the condiment container;

wherein in the active state, the vibrator facilitates vibrating the condiment container and the condiment container facilitates vibrating the condiment.

4. A condiment dispenser comprising of:

a vibrator and a condiment container comprising:

a storage space filled with the condiment:

wherein the storage space is confined within: a set of surrounding walls, a bottom wall situated at a bottom side of the storage space and a top wall situated at a top side of the storage space:

wherein the bottom wall includes a multiplicity of dispensing apertures;

wherein the vibrator is configured to vibrate and also to vibrate the condiment when the vibrator is in an active state;

wherein when the vibrator is in the active state, the vibrator is configured to facilitate dispensing the condiment via the multiplicity of dispensing apertures;

wherein the storage space comprises:

a banded frame situated on a top side of the bottom wall;

wherein the banded frame comprises of a multiplicity of spaced bands which are configured to cover the multiplicity of dispensing apertures and to block the multiplicity of dispensing apertures when the banded frame is in a blocking position;

wherein when the banded frame is in an unblocking position, the multiplicity of spaced bands are configured not to cover the multiplicity of dispensing apertures and do not block the multiplicity of dispensing apertures;

wherein, at the unblocking position, the banded frame facilitates dispensation of the condiment via the multiplicity of dispensing apertures when the vibrator is in the active state;

wherein the vibrator is mechanically attached to the banded frame by a vibrating bar and facilitates vibrating of the banded frame when the vibrator is in the active state;

wherein the vibrations of the banded frame are configured to vibrate the condiment.

5. A condiment dispenser comprising of a vibrator and a condiment container comprising:

a storage space filled with the condiment;

wherein the storage space is confined within: a set of surrounding walls, a bottom wall situated at a bottom side of the storage space and a top wall situated at a top side of the storage space;

wherein the bottom wall includes a multiplicity of dispensing apertures;

wherein the vibrator is configured to vibrate and also to vibrate the condiment when the vibrator is in an active state;

wherein when the vibrator is in the active state, the vibrator is configured to facilitate dispensing the condiment via the multiplicity of dispensing apertures;

the condiment dispenser comprising: an electrical power source and an electrical switch;

wherein the electrical switch is electrically connected to the vibrator and to the electrical power source;

wherein activating the electrical switch switches the vibrator into the active state in which the vibrator is vibrating;

wherein when the electrical switch is not activated the vibrator is in an inactive state in which the vibrator is not vibrating;

wherein the storage space comprises:

a banded frame situated on a top side of the bottom wall;

wherein the banded frame comprises of a multiplicity of spaced bands which are configured to cover the multiplicity of dispensing apertures and to block the multiplicity of dispensing apertures when the banded frame is in a blocking position;

wherein when the banded frame is in an unblocking position, the multiplicity of spaced bands are configured not to cover the multiplicity of dispensing apertures and do not block the multiplicity of dispensing apertures;

wherein, at the unblocking position, the banded frame facilitates dispensation of the condiment via the multiplicity of dispensing apertures when the vibrator is in the active state;

wherein the vibrator is mechanically attached by a vibrating bar to the banded frame;

wherein the vibrator facilitates moving the banded frame into the unblocking position when the vibrator is switched into the active state;

wherein the vibrator facilitates moving the banded frame into the blocking position when the vibrator is switched into the inactive state.

6. A condiment dispenser comprising of:

a vibrator and a condiment container comprising:

a storage space filled with the condiment;

wherein the storage space is confined within: a set of surrounding walls, a bottom wall situated at a bottom side of the storage space and a top wall situated at a top side of the storage space;

wherein the bottom wall includes a multiplicity of dispensing apertures;

wherein the vibrator is configured to vibrate and also to vibrate the condiment when the vibrator is in an active state;

wherein when the vibrator is in the active state, the vibrator is configured to facilitate dispensing the condiment via the multiplicity of dispensing apertures;

wherein the condiment dispenser comprising: an electrical power source and an electrical switch;

wherein the electrical switch is electrically connected to the vibrator and to the electrical power source;

wherein activating the electrical switch switches the vibrator into the active state in which the vibrator is vibrating;

wherein when the electrical switch is not activated the vibrator is in an inactive state in which the vibrator is not vibrating;

wherein the storage space comprises:

a banded frame situated on a top side of the bottom wall;

wherein the banded frame comprises of a multiplicity of spaced bands which are configured to cover the multiplicity of dispensing apertures and to block the multiplicity of dispensing apertures when the banded frame is in a blocking position;

wherein when the banded frame is in an unblocking position, the multiplicity of spaced bands are configured not to cover the multiplicity of dispensing apertures and do not block the multiplicity of dispensing apertures;

wherein, at the unblocking position, the banded frame facilitates dispensation of the condiment via the multiplicity of dispensing apertures when the vibrator is in the active state;

wherein the electrical switch has a pressing button which facilitates manual activation of the electrical switch when pressed;

wherein the pressing button also is mechanically connected with the banded frame using a sliding bar;

wherein the pressing button is configured to move the banded frame into the unblocking position when pressed;

wherein the pressing button is equipped with a retaining spring which moves back the pressing button and deactivates the electrical switch when the pressing button is not pressed;

wherein the retaining spring also moves back the sliding bar and the banded frame into the blocking position when the pressing button is not pressed.

7. A condiment dispenser comprising of:

a vibrator and a condiment container comprising:

a storage space filled with the condiment;

wherein the storage space is confined within: a set of surrounding walls, a bottom wall situated at a bottom side of the storage space and a top wall situated at a top side of the storage space;

wherein the bottom wall includes a multiplicity of dispensing apertures;

wherein the vibrator is configured to vibrate and also to vibrate the condiment when the vibrator is in an active state;

wherein when the vibrator is in the active state, the vibrator is configured to facilitate dispensing the condiment via the multiplicity of dispensing apertures;

wherein the storage space comprises:

a banded frame situated on a top side of the bottom wall;

wherein the banded frame comprises of a multiplicity of spaced bands which are configured to cover the multiplicity of dispensing apertures and to block the multiplicity of dispensing apertures when the banded frame is in a blocking position;

wherein when the banded frame is in an unblocking position, the multiplicity of spaced bands are configured not to cover the multiplicity of dispensing apertures and do not block the multiplicity of dispensing apertures;

wherein, at the unblocking position, the banded frame facilitates dispensation of the condiment via the multiplicity of dispensing apertures when the vibrator is in the active state;

wherein a multiplicity of tapered ramps are attached to the surrounding walls which engage with the banded frame at the bottom side of the container;

wherein the multiplicity of tapered ramps are configured to prevent leakage of the condiment out of the storage space.

8. A multiple condiments dispenser comprising of:

a vibrator and at least two condiment containers each of said condiment containers comprising:

a particular storage space filled with a particular condiment;

wherein each of the particular storage spaces is confined within: a particular set of surrounding walls, a particular bottom wall situated at a bottom side of the particular storage space and a particular top wall situated at a top side of the particular storage space;

wherein the particular bottom wall includes a particular multiplicity of dispensing apertures;

wherein the vibrator is structurally attached to the multiple condiments dispenser;

wherein the vibrator is configured to vibrate and also to vibrate all the particular condiments in the multiple condiments dispenser when the vibrator is in an active state;

wherein when the vibrator is in the active state, the vibrator is configured to facilitate dispensing each of the particular condiments via the particular multiplicity of dispensing apertures situated at the particular storage space;

the multiple condiments dispenser comprising: an electrical power source and a multiplicity of particular electrical switches;

wherein all the particular electrical switches are electrically connected in parallel to the vibrator and to the electrical power source;

wherein activating any of the particular electrical switches, is switching the vibrator into the active state in which the vibrator is vibrating;

wherein when all the particular electrical switches are not activated the vibrator is in an inactive state in which the vibrator is not vibrating.

9. A multiple condiments dispenser comprising of:

a vibrator and at least two condiment containers each of said condiment containers comprising:

a particular storage space filled with a particular condiment;

wherein each of the particular storage spaces is confined within: a particular set of surrounding walls, a particular bottom wall situated at a bottom side of the particular storage space and a particular top wall situated at a top side of the particular storage space;

wherein the particular bottom wall includes a particular multiplicity of dispensing apertures;

wherein the vibrator is structurally attached to the multiple condiments dispenser;

wherein the vibrator is configured to vibrate and also to vibrate all the particular condiments in the multiple condiments dispenser when the vibrator is in an active state;

wherein when the vibrator is in the active state, the vibrator is configured to facilitate dispensing each of the particular condiments via the particular multiplicity of dispensing apertures situated at the particular storage space;

wherein each of the particular storage spaces comprising:

A particular input opening;

wherein the particular input opening is situated at the top side of the particular storage space and is configured to facilitate supplementing the particular condiment container with the particular condiment;

wherein the particular input opening is equipped with a particular rotatable door which has an opened position in which the particular rotatable door facilitates supplementation of the particular condiment into the particular container;

wherein the particular rotatable door has a closed position in which the particular rotatable door seals the particular input opening.

10. The multiple condiments dispenser, of claim 8, wherein the particular storage space comprises:

a particular banded frame situated on a top side of the particular bottom wall;

wherein the particular banded frame comprises of a particular multiplicity of spaced bands which are configured to cover the particular multiplicity of dispensing apertures and block the particular multiplicity of dispensing apertures when the particular banded frame is in a blocking position;

wherein when the particular banded frame is in an unblocking position, the particular multiplicity of spaced bands are configured not to cover the particular multiplicity of dispensing apertures and do not block the particular multiplicity of dispensing apertures;

wherein, at the unblocking position, the particular banded frame facilitates dispensation of the particular condiment via the particular multiplicity of dispensing apertures when the vibrator is in the active state.

11. The multiple condiments dispenser of claim 10, wherein each of the particular electrical switches has a particular pressing button which facilitates manual activation of the particular electrical switch when pressed;

wherein each of the particular electrical switches when activated is also configured to activate the vibrator;

wherein each of the particular pressing buttons also is mechanically connected with the particular banded frame which pertains to that particular condiment container and moves the particular banded frame into the unblocking position when pressed;

wherein each of the particular pressing buttons is equipped with a particular retaining spring which moves back the particular pressing button and deactivates the particular electrical switch when the particular pressing button is not pressed;

wherein, the particular retaining spring also moves back the particular pressing button and the particular banded frame into the blocking position when the particular pressing button is not pressed.

12. The multiple condiments dispenser of claim 10, wherein a multiplicity of tapered ramps are attached to the particular surrounding walls which engage with the particular banded frames at the bottom sides of the particular containers;

wherein the multiplicity of tapered ramps are configured to prevent leakage of the particular condiments out of their particular storage spaces.

* * * * *